United States Patent [19]

Booth et al.

[11] 4,210,326

[45] Jul. 1, 1980

[54] PORTABLE BASEBALL PITCHING TARGET AND CATCHING APPARATUS

[76] Inventors: John A. Booth, 505 E. Winchcomb, Scottsdale, Ariz. 85254; Jess H. Ingle, 6019 N. 36th Dr., Phoenix, Ariz. 85019

[21] Appl. No.: 920,169

[22] Filed: Jun. 29, 1978

[51] Int. Cl.[2] ..... A63B 69/40

[52] U.S. Cl. ..... 273/26 A; 273/127 R; 273/402

[58] Field of Search ..... 273/26 A, 29 A, 127 R, 273/127 B, 102 R, 102 S, 102.4, 103, 105, 105.5, 101, 102.1 R, 102.1 B, 102.1 C, 102.1 A, 102.2 R, 102.2 B, 102.2 S, 102.3, 176 B, 176 D, 177 B, 181 R, 181 A, 181 B, 181 C, 181 D, 181 F, 181 J, 181 K, 182 R, 182 A, 183 R, 85 R, 85 A, 85 B, 1 B, 1.5

[56] References Cited

U.S. PATENT DOCUMENTS

| | | | |
|---|---|---|---|
| 2,657,058 | 10/1953 | Mulcahy | 273/26 A |
| 3,312,467 | 4/1967 | Dawson | 273/102 R |
| 3,328,033 | 6/1967 | Hendry | 273/103 |
| 3,399,899 | 9/1968 | Harry | 273/1.5 |
| 3,408,071 | 10/1968 | Lundy | 273/26 A |
| 3,856,298 | 12/1974 | Frantti | 273/127 R |
| 4,127,272 | 11/1978 | Pennell | 273/102 R |

FOREIGN PATENT DOCUMENTS

| | | | |
|---|---|---|---|
| 787570 | 9/1935 | France | 273/26 A |

OTHER PUBLICATIONS

Popular Mechanics, Aug. 1972, pp. 128–129.

*Primary Examiner*—Richard C. Pinkham
*Assistant Examiner*—T. Brown
*Attorney, Agent, or Firm*—H. Gordon Shields

[57] ABSTRACT

Portable target apparatus includes a variable size aperture for a baseball pitcher and includes a net which comprises a catcher or a stop for the balls which are pitched through the selectively variable target area. The size of the target aperture area can be varied by horizontally and vertically movable straps which are mounted on the target frame structure.

9 Claims, 9 Drawing Figures

FIG. 1
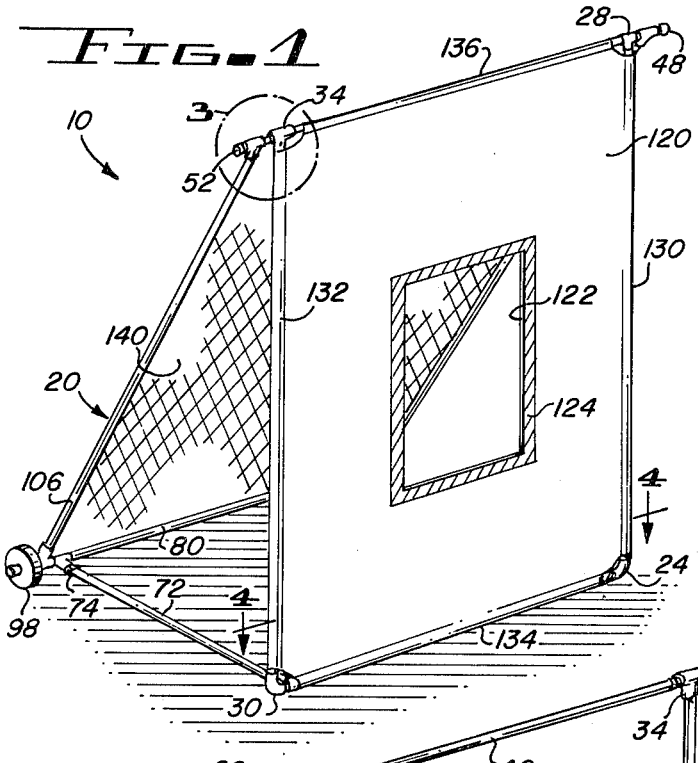
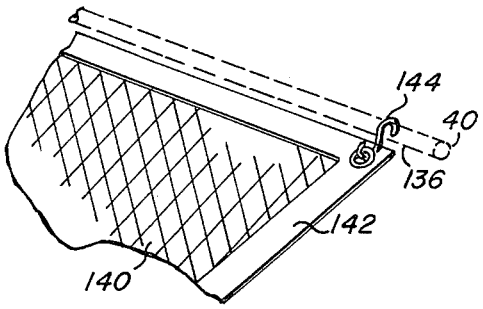
FIG. 5
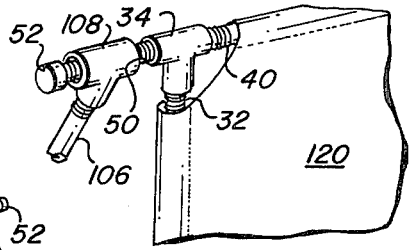
FIG. 3
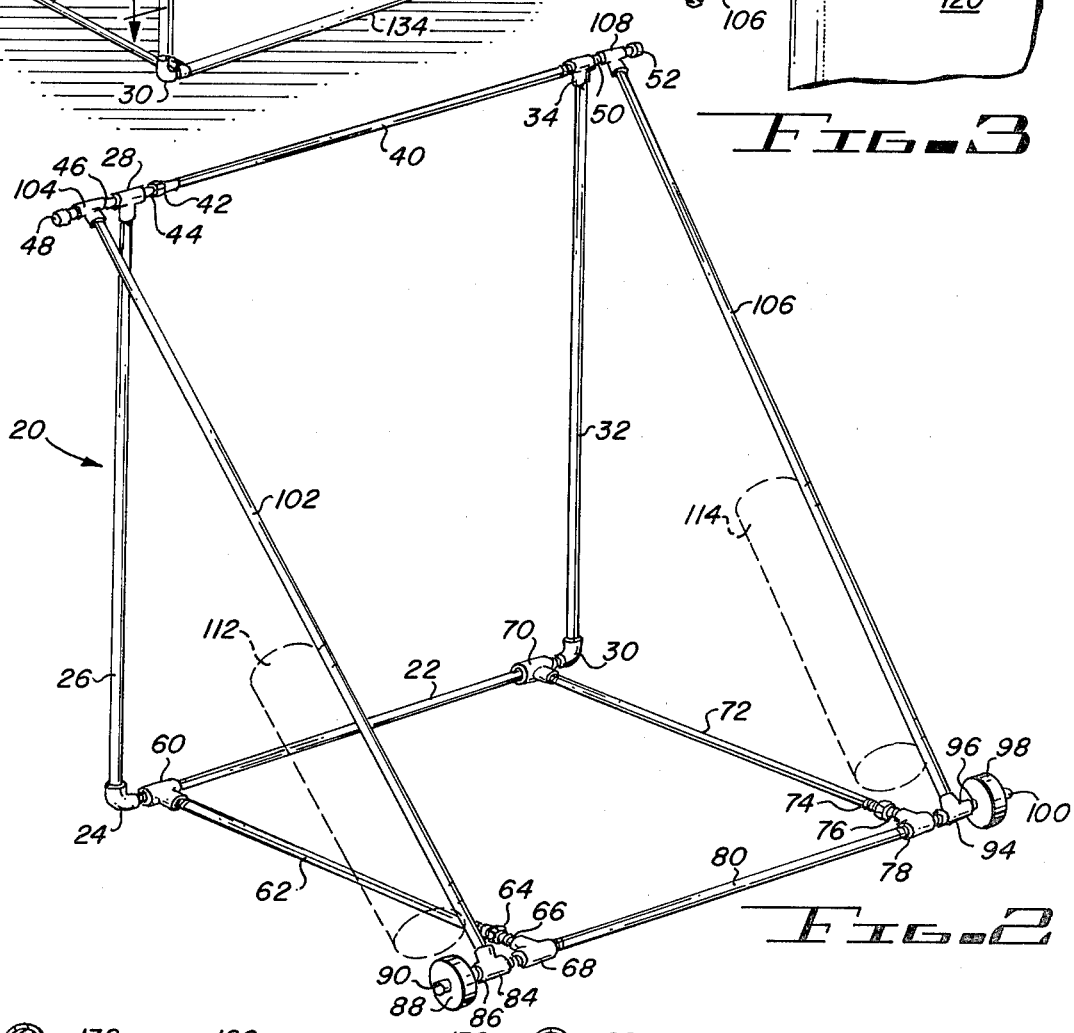
FIG. 2
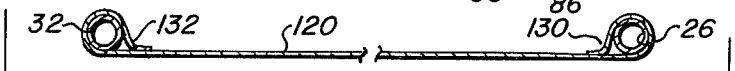
FIG. 4

PORTABLE BASEBALL PITCHING TARGET AND CATCHING APPARATUS

BACKGROUND OF THE INVENTION

1. Field of the Invention

This invention relates to portable apparatus which provides a target and a catcher/stop for thrown baseballs, and, more particularly, to movable or portable apparatus which includes both a target of selectively variable dimensions and a stop for the thrown baseballs.

2. Description of the Prior Art

In order to provide an adequate target for a pitcher or pitchers in baseball, a team mate catcher usually works with a pitcher. However, there are at least two limitations imposed by the use of one catcher for one pitcher. One limitation is that a man, the catcher, must be provided which utilizes time that otherwise could be used by the catcher in other kinds of practice. A second limitation is that the target presented by the catcher is limited to the size and specific location of the glove which the catcher holds for the pitcher. That is, the catcher's mitt or glove, which comprises the target or aiming point for the pitcher as he works for speed and control, is only a limited target set in a rather undefined but larger strike zone which a pitcher must work with when actually facing a batter during a game. It is obviously impractical to have an individual, simulating a batter with a definable or actual strike zone, stand by the catcher during pitching practice. The problems are compounded, of course, when there are several pitchers, which there usually are, in need of practice.

To overcome the problems inherent with the use of a human catcher for each pitcher, several alternative apparatus have been suggested. One such alternative is illustrated in U.S. Pat. No. 1,043,308. A fixed target is presented in the '308 patent for a pitcher to aim at. If the pitcher misses the actual target, the ball impinges on a front portion which is disposed about the target area. Whether a ball impinges on the front portion or in the target area, both balls are stopped and are returned to the pitcher by means of a pair of troughs extending forwardly or in the direction of the pitcher from the apparatus. The entire apparatus is fixed in place.

Another apparatus is illustrated in U.S. Pat. No. 1,142,184, which comprises a frame to which is secured a target area outlined and extending rearwardly from a planar portion. The frame in the '184 patent, like the frame in the '308 patent, is secured to a fixed location and is not easily movable.

The apparatus disclosed in U.S. Pat. No. 2,059,365 is secured to a fixed location and is similar to the '184 apparatus. The apparatus in the '365 patent comprises a three-dimensional screen area which includes a simulated batter target and several specific locations adjacent the batter which serve as specific targets or aiming points for the pitcher. However, the specific aiming points in the '365 patent do not comprise cut-out target portions or strike zones such as are shown in the '184 and '308 patents.

Apparatus not entirely dissimilar to that of the '365 patent is illustrated in U.S. Pat. No. 2,126,102. The '102 patent includes a tubular frame which is enclosed at the sides, top, and back by a netting to stop balls, and a strike zone is suspended to the frame at the front of the appartus. As in the other patents, the '102 apparatus is not easily moved or transportable.

A back-stop apparatus of a generally circular nature is illustrated in U.S. Pat. No. 3,810,616. The apparatus includes a relatively wide target area for the pitcher to aim at and includes apparatus for stopping and collecting the baseballs thrown at the apparatus. Netting and the like is used in the apparatus.

In U.S. Pat. No. 3,929,334, a loop with a flexible net secured thereto is suspended between a pair of vertically extending posts. The loop comprises the target for the pitcher and the net secured to the loop stops and holds the balls which are thrown into the target area of the loop. The loop may be suspended at variable heights to provide a target for throwing, rather than approximate strike zones of a potential batter.

It will be noted that none of the catcher apparatus illustrated in any of the above discussed patents is easily movable and none of the patents illustrates a variable sized target zone or strike zone at which a pitcher may aim. The apparatus of the present invention does include a variable size strike zone and is both foldable for storage and movable for portability, yet it remains in place during use without being anchored to the ground.

SUMMARY OF THE INVENTION

Foldable and portable catching and aiming apparatus for baseball pitchers is described and claimed herein. The apparatus comprises a tubular frame of a generally rectangular front frame configuration with a sloping rear frame. The front frame includes a preferably opaque sheet with a strike zone defined and cut through the sheet and outlined for ready identification. The strike zone may be altered in size and configuration, as desired. The sloping rear frame includes relatively flexible or "dead" netting to stop balls which are thrown through the strike zone. Wheels are secured to the rear of the apparatus for ease of moving the apparatus.

Among the objects of the present invention are the following:

To provide new and useful baseball target apparatus;

To provide new and useful apparatus for stopping thrown baseballs;

To provide new and useful portable target apparatus for thrown balls;

To provide new and useful baseball target apparatus having a variable strike or target zone;

To provide new and useful baseball target apparatus which is foldable for storage; and To provide new and useful target apparatus for catching baseballs.

BRIEF DESCRIPTION OF THE DRAWING

FIG. 1 is a perspective view of the apparatus of the present invention.

FIG. 2 is a perspective view of the frame of the apparatus of FIG. 1.

FIG. 3 is an enlarged view of the apparatus of FIG. 1 taken generally from circle 3 of FIG. 1.

FIG. 4 is a view in partial section of the apparatus of FIG. 1 taken generally along line 4—4 of FIG. 1.

FIG. 5 is an enlarged fragmentary view illustrating the securing of a net to the frame, as included in the present invention.

DESCRIPTION OF THE PREFERRED EMBODIMENT

Figure 6:
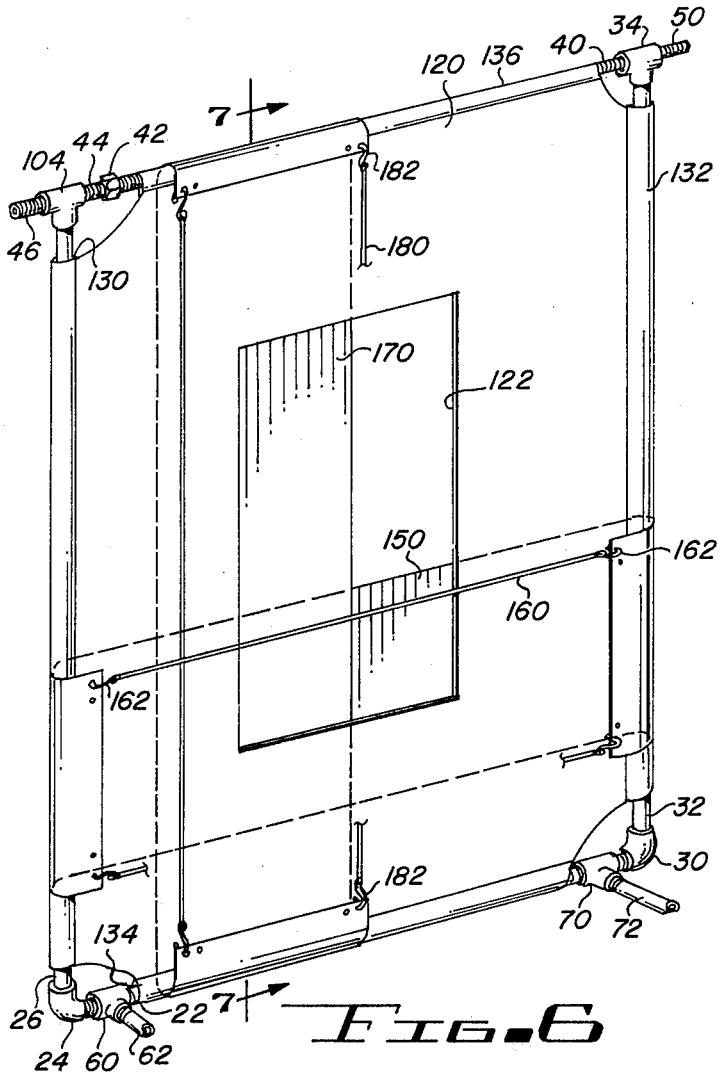
FIG. 6 is a view, partially broken away, illustrating a portion of the front frame and target portion of the apparatus of the present invention.

FIG. 1 is a perspective front view of the apparatus of the present invention, which comprises a portable baseball pitching target and catching apparatus 10. The apparatus 10 includes a frame 20 which supports a front target panel 120 and a rear net 140.

FIG. 2 comprises a perspective view of the frame 20 employed with the apparatus of the present invention. The frame 20 in FIG. 2 is viewed generally from the rear.

FIG. 3 is an enlarged fragmentary view of a portion of the apparatus of FIG. 1 taken generally from circle 3 of FIG. 1, showing the details of a corner of the frame 20 and the target panel 120 at the top of the frame.

FIG. 6 is a perspective view of a portion of the frame 20, comprising the front portion, illustrating the employment of the front target panel or sheet 120 with a pair of auxiliary strips. For the following discussion of the frame, reference will be made to FIGS. 1, 2, 3, and 6.

The frame 20 includes a lower front member 22, which is preferably a section of one-half inch galvanized pipe. The frame members employed with the apparatus of the present invention are also preferably sections of one-half inch galvanized pipe for purposes of structural integrity, for its resistance to rust, for the strength and ability to withstand repeated abuse from pitched balls, and for weight. The apparatus of the present invention is preferably heavy enough to remain in position even though the front panel or the net is impacted directly by pitched balls. Accordingly, the employment of galvanized pipe aids in providing weight, strength, and durability for the apparatus.

An elbow 24 and an elbow 30 are secured to the lower front frame member 22 and they in turn receive vertical frame members 26 and 32, respectively. The vertical frame members 26 and 32 are in turn secured to tees 28 and 34, respectively, remote from the elbows 24 and 30. An upper front frame member 40 is secured to the tee 34 at one end, and at its opposite end it is secured to a union 42. The union 42 is also secured to a nipple 44. The nipple 44 extends between the union 42 and the tee 28. Thus the front portion of the frame 20 comprises a generally rectangular frame in which the lower and upper frame members 22 and 40 are substantially parallel to each other, and the vertical front frame members 26 and 32 are substantially parallel to each other. The frame members 22 and 40 are generally horizontal, with the lower frame member 22 resting or disposed on the ground.

Outwardly from the tee 28, remote from the nipple 44 and the upper frame member 40, is a nipple 46. The nipple 46 thus comprises an extension of the upper frame member 40 through the union 42, the nipple 44, and the tee 28. The end of the nipple 46 remote from the tee 28 is closed by a cap 48.

At the opposite end of the member 40, remote from the nipple 46, the tee 28, the nipple 44, and the union 42, is a nipple 50 which is secured at one end to the tee 44. The end of nipple 50 remote from the tee 34 is closed by a cap 52.

The lower portion of the frame includes a pair of lower side members 62 and 72. The lower side frame member 62 is secured to a tee 60 which extends over the lower front frame member 22 adjacent the elbow 24. The other side member 72 is secured to a tee 70 which also extends over the lower frame member 22 adjacent the elbow 30. The tees 60 and 70 are movable over the front frame member 22 since their internal diameter is slightly larger than the external or exterior diameter of the lower front frame member 22.

Remote from the the 60, the lower side frame member 62 is secured to a union 64. In turn, the union 64 is secured to one end of a nipple 66. The other end of the nipple 66 is secured to a tee 68.

Similarly, the lower side frame member 72, remote from the tee 70, is secured to a union 74. A nipple 76 extends from the union 74 to a tee 78. The nipple 76 is thus secured both to the union 74 and the tee 78.

A lower rear frame member 80 extends between, and is secured to, a pair of tees 84 and 94. The tees 68 and 78 extend over the frame member 80 adjacent to, but inwardly from, the tees 84 and 94. The lower rear frame member 80 is substantially parallel to the lower front frame member 22, and the side frame members 62 and 72 are parallel to each other. Thus, a generally rectangular frame is defined by the lower frame members, which comprise a base.

A nipple 86 is secured to the tee 84, remote from the tee 68. The nipple 86 comprises an axle for a wheel 88. The nipple 86 is closed by a cap 90, which also serves to secure the wheel 88 to the nipple 86.

A nipple 96 is secured to the tee 94 remote from the tee 78. The nipple 96 comprises an axle for a second wheel 98. The wheel 98 is held in place by a cap 100, and the cap also serves to close the end of the nipple 96.

The tees 84 and 94 are disposed at an acute angle with respect to the lower frame members 62 and 72, respectively. A diagonal brace or frame member 102 is secured to the tee 84 at one end and to a tee 104 at its opposite end. The tee 104 extends over the nipple 46, which is in turn secured to the tee 28. A cap 48 closes the nipple 46 remote from the tee 48 and serves to hold the tee 104 onto the nipple 46. The tee 104 is disposed outwardly from the tee 28.

A second diagonal brace or frame member 106 is secured to the tee 94 and it extends to, and is appropriately secured to, a tee 108. The tee 108 extends over the nipple 50 which is secured to the tee 34. The tee 108 is disposed outwardly from the tee 34. The nipple 50 is closed by the cap 52 remote from the tee 34. The cap 52 also serves to hold the tee 108 on the nipple 50. The tees 104 and 108 are pivotably movable on the nipples 46 and 50, respectively. Thus, while the tees 28 and 34 are secured to, and comprise part of, the rectangular frame which includes the lower front frame member 22, the vertical side frame members 26 and 32, and the upper front frame member 40, the tees 104 and 108 extend over the nipples 46 and 50 to allow a movable or pivotable relationship between the diagonal frame members 102 and 106 and the front rectangular frame. The interior or internal diameters of the tees 104 and 108, which extends over the nipples 46 and 50, respectively, are slightly larger than the external or exterior diameters of the respective nipples, in a manner similar to the relationship between the lower frame member 22 and the tees 60 and 70, as discussed above. And, also similar is the pivoting action of the tees 68 and 78 on the lower rear frame member 80 to the pivoting action of the tees 60 and 70 and the tees 104 and 108 on their respective frame members, as discussed.

Since the frame 20 is preferably fabricated out of pipe, as has been discussed above, the union 42 is necessary for securing together the generally rectangular front frame including the frame members 22, 26, 32, and 40. At the bottom of the frame, the lower rectangular frame including the frame members 22, 62, 72, and 80 include a pair of unions 64 and 74. However, the use of the unions 64 and 74, while allowing a rectangular frame to be assembled, is for a different purpose, since only one union would be required if the lower or bottom frame were to remain in rectangular configuration. However, such is not the case. For ease of movement, the unions 64 and 74 may be disconnected to allow the frame 20 to be folded for storage or for movement. With the union 64 and 74 disconnected from the nipples 66 and 76, respectively, the tees 68 and 78 will pivot or move downwardly, by gravity, on the lower rear frame member 80. The nipples 66 and 76 will accordingly be hanging downwardly under the force or influence of gravity. The radius of each of the wheels 88 and 98 is greater than the combined length of the nipples 66 and 76 with the portions of the tees 68 and 78 to which the nipples are respectively secured, so that the nipples 66 and 76, when hanging downwardly, do not contact the ground. This prevents the nipples from dragging or from acting as a stop to prevent the movement of the apparatus 10.

With the unions 64 and 74 disconnected, the lower or bottom side frame members 62 and 72 may be pivoted upwardly on the front lower frame member 22 and may be easily secured or tied to the respective front side frame members 26 and 32. The front frame, comprising the frame members or elements 22, 26, 32, and 40, is then allowed to pivot on the upper front frame member 40 and its extensions, including the nipple 46 and the nipple 50. The top frame member 40 thus pivots within the tees 104 and 108 to move relative to the diagonal braces 102 and 106. The front frame is thus able to nest within the diagonals 102 and 104 and adjacent the lower rear frame member 80 in an aligned orientation.

The unions 64 and 74 accordingly allow the front frame and the lower side frame members to be releasably secured to the lower rear frame member 80, and the pivotable or movable relationship between the tees 60 and 70 with respect to the lower front frame member 22, and the tees 104 and 108 with respect to the top front frame member 40 allows the apparatus to fold up for movement or for storage.

Figure 7:
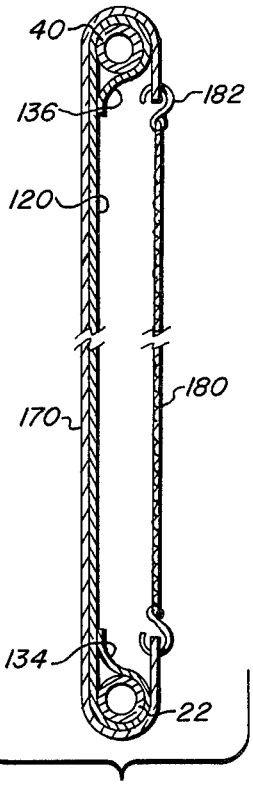
FIG. 7 is a view in partial section of the apparatus of FIG. 6 taken generally along line 7—7 of FIG. 6.

The securing of the front target panel or sheet 120 to the front frame is best illustrated in FIGS. 1, 3, 4, 6, and 7. FIG. 4 is a view in partial section of the apparatus of FIG. 1 taken generally along line 4—4 of FIG. 1, illustrating the securing of the front panel 120 to the vertical side frame members 26 and 32. FIG. 6 comprises a view of the target panel 120 secured to the front frame, and FIG. 7 is a view in partial section of the apparatus of FIG. 6 taken generally along line 7—7 of FIG. 6.

The front panel 120, as shown best in FIGS. 1 and 6, comprises a target sheet, preferably made of relatively heavy material, such as a heavy grade of vinyl, so as to withstand the rigors of numerous thrown balls impinging on it. A rectangular aperture 122 is disposed in about the center of the rectangular target panel 120. The aperture 122 is carefully delineated by a rectangular outline 124 which extends outwardly about the perimeter of the aperture. The aperture 122, as thus clearly defined by the outline 124, comprises a vertically elongated rectangular strike zone which corresponds to the strike zone extending above home plate in the game of baseball. The width of the aperture 122 accordingly corresponds to the width of a strike zone, which is the width of the plate. The height or length of the aperture 122 corresponds to the average height of a strike zone, which is the distance between the knees and the shoulders of a batter. The size of the strike zone may be reduced, as discussed below in conjunction with FIGS. 6, 7, 8, and 9.

The rectangular target panel 120 is secured to the frame members of the front frame by a plurality of sleeves which extend along the sides, top, and bottom of the panel 120. The pockets into which the frame members are inserted are best illustrated in FIGS. 4 and 7. In addition, FIGS. 3 and 6 also illustrate the pockets, and FIG. 1 includes an outline of the pockets. The diagonal frame members 102 and 106 are secured to the top member 40 of the front frame 20 outwardly of the panel 120 to support the front frame and the panel on the base and to allow folding of the apparatus without interfering with the panel.

The frame member 26 extends through a sleeve 130, while the frame member 32 extends through a sleeve 132, both of which sleeves 130 and 132 are generally parallel to each other and are slightly larger than the diameter of the frame members 26 and 32, respectively. The bottom frame member 22 extends through a sleeve 134, while the upper frame member 40 extends through a sleeve 136. As is well known and understood, the frame members and the target panel 120, with its sleeves, are all appropriately dimensioned so as to present a substantially taut panel when the frame is assembled to the panel. For convenience, as clearly shown in FIGS. 1, 3, and 6, to provide adequate space and access for the assembly of the frame and the panel, the four outer corners of the panel 120 are cut away diagonally between adjacent sides.

With the aperture 122 as a target, a pitcher aims for the imaginary strike zone defined by the aperture 122 and marked or identified by the outline 124. Hopefully, most of the balls thrown by a pitcher will go through the aperture 122. Balls that do not go through the aperture 122 will, unless rather wildly thrown, impinge on the panel 120 and will thus be stopped. The balls which are thrown through the aperture 122 will impinge on a rather limp or "dead" net 140 which is secured to the lower rear frame member 180, the upper frame member 40, and the diagonal side frame members 102 or 106. The net 140, being limp or "dead" stops the balls and causes them to drop generally to the ground within the lower frame members. That is, when the balls impinge on the net 140, they do not tend to bounce or ricochet off the net. Rather, they simply drop to the ground where they can be easily retrieved.

The net 140, as shown in FIG. 5, simply hooks to the frame members as above identified and discussed. FIG. 5 comprises an enlarged fragmentary view of a corner of the net 140, illustrating the securing of the net to upper frame member 40. The net 140, rectangular in configuration, includes a binding 142 about its edges. A hook 144 extends through a grommet at one corner of the binding 142 and the hook 144 extends about the sleeve 136 and accordingly about the upper frame member 40 to secure the net 140 to the frame member 40. A plurality of hooks, such as the hook 144, secured to grommets at the edges of the net 140 are used to secure the net to the frame members 22, 40, 102, and 106.

Figure 8:
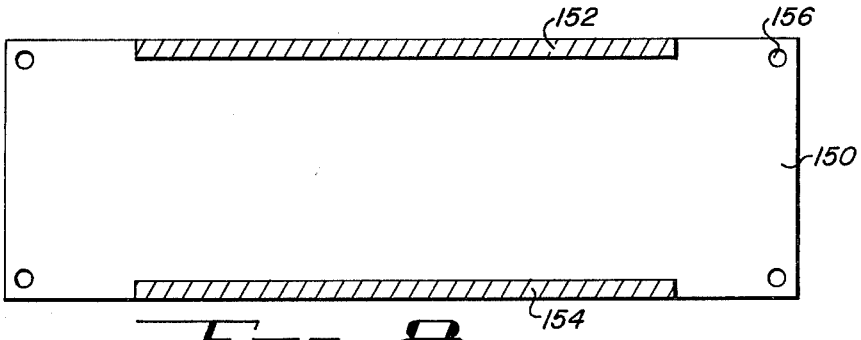
FIG. 8 is a plan view of a portion of the apparatus of the present invention.
Figure 9:
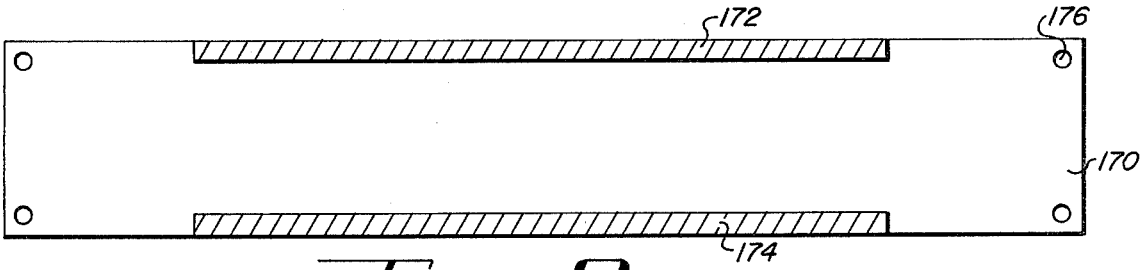
FIG. 9 is a plan view of a portion of the apparatus of the present invention which is used in conjunction with the apparatus of FIG. 8.

A pair of rectangular strips 150 and 170, illustrated in FIGS. 8 and 9, respectively, are used to reduce the size of the target zone. The aperture 122 is thus reduced in size by securing the strips 150 and 170 to the front frame. The strips 150 and 170 are both rectangular in configuration, but both differ in overall size. The strips or panels 150 and 170 are preferably made of the same type material as the front or target panel 170, and the strips or panels 150 or 170 are preferably colored the same as the front panel 120. By moving either or both panels 150 and 170, the size and shape of the aperture can be varied as desired.

The panel 150 comprises the horizontal panel and is thus shorter, lengthwise, than the panel 170. The panel 170, longer than panel 150, is the vertical panel. The horizontal panel or strip 150 includes a pair of zone markers 152 and 154 which are preferably the same color as the outline 124 for the target panel 120. The markers 152 and 154 are disposed at the top and bottom edges (i.e., the longer edges) of the horizontal panel 150.

At the four corners of the strip 150 are grommets 156 which are used to secure the strip to the front frame.

The vertical strip 170, also rectangular in configuration, includes a pair of zone markers 172 and 174 adjacent the side edges (also the longer edges) of the panel or strip. A grommet 176 is located at each of the four corners of the panel and the grommets, like the grommets 156, are employed in securing the strip or panel 170 to the frame 20.

FIG. 6 illustrates the securing of the horizontal panel 150 and the vertical panel 170 to the frame 20 to reduce the size of the strike zone by decreasing the effective size of the aperture 122. FIG. 6 views the front frame and panel 120 from the rear. The aperture 122 is thus defined by a portion of its outline 124 (see FIG. 1), and depending on the specific placement of the strips or panels 150 and 170, by the zone markers 152 or 154 for the panel 150, or the zone markers 172 or 174 for the strip 170.

Referring to both FIGS. 1 and 6, it will be noted that portions of two adjacent sides of the outline 124 will comprise part of the newly defined strike zone. The other two sides which define the strike zone include one of the markers, either 152 or 154, from the horizontal panel 150, and one of the markers, either 172 or 174, from the vertical panel 170. Which marker is used from each of the panels 150 and 170 depends on the particular placement of the panels.

The securing of the panels or strips to the frame is illustrated in FIG. 7, which comprises a view in partial section of the apparatus of FIG. 6, taken generally along line 7—7 of FIG. 6. The bottom and top horizontal frame members 22 and 40 are shown extending through sleeves 134 and 136, respectively, of the front panel 120. The vertical strip or panel 170 is shown extending on, or juxtaposed against, the target panel 120 and around the outside of the sleeves 134 and 136 at the back or rear side of the panel 120. A cord 180 is shown extending between a pair of hooks 182. The hooks 182 in turn extend through the grommets 176 (see FIG. 9) of the strip 170. The elastic cords serve to hold the strip or panel 170 in place and, like the target panel 120, hold the panel 170 relatively taut on the front frame members 22 and 40. The employment of the pair of elastic cords 180 is clearly shown in FIG. 6.

Referring again to FIG. 6, the horizontal panel 150 is secured to the side frame members 26 and 32 in a substantially identical manner as the panel 170. A pair of elastic cords 160, each secured to a pair of hooks 162, is used to fasten or secure the panel 150 to the vertical frame members 26 and 32. The hooks 162 extend through the grommets 156, shown in FIG. 8.

By moving the panels 150 and 170 as desired, the strike zone defined by portions of two adjacent edges of the aperture 122 may be reduced either vertically or horizontally, or both, by the appropriate adjustment of the strips 150 and 170, respectively. That is, by moving the strips 150 and/or 170 relative to the panel 120, and particularly relative to the aperture 122, a new strike zone, reduced in size, is defined by the exposed edges of the aperture 122 and by an edge of either or both of the panels 150 and 170.

For ease of adjustment, the zone markers at the edges of the panels 150 and 170 are both marked or outlined. Accordingly, the particular edge or marker of either of the panels which is adjacent the opening or aperture 122 thus becomes one edge of the new strike zone. If having both edges of the panels outlined is a problem, or causes confusion to a particular pitcher, it is obvious that one edge only may be marked. The marking of only one edge necessitates the removal of a panel if, for example, the strike zone is to be completely reversed. Thus, if, rather than have the panel 150 covering the lower portion of the aperture 122, it is desired that the panel 150 be raised to cover an upper portion of the aperture 122, then the panel 150, with only a single marked edge, must be removed and inverted so that the marked edge will then be on the lower edge of the panel 150 to outline the upper edge or the upper limit of the new strike zone. Thus, for convenience, both edges of the strips 150 and 170 are illustrated in FIGS. 8 and 9, respectively, as being marked or outlined.

FIG. 5 comprises an enlarged fragmentary view illustrating the securing of the net 140 to the frame of the apparatus 10. As previously indicated, the net 140 is preferably very loose and thus renderes any ball which impinges on the net quite "dead". That is, the net is so loose that the energy of the pitched balls which impinge on the net after being thrown through the opening 122 in the front panel 120 is absorbed by the net. With the energy of the ball absorbed by the very loose net, the balls will drop downwardly within the lower frame, as best seen in FIG. 1.

As can be understood by referring to FIGS. 1 and 4 in addition to FIG. 5, the net 140 extends downwardly and rearwardly from the upper frame member 40 to the lower rear member 80. The natural slope or slant to the net in and of itself causes the balls to be deflected downwardly within the lower frame of the apparatus 10.

The net 140 includes a bound edge 142 extending about the periphery of the net. The net, as may be seen from FIGS. 1 and 4, is of a generally rectangular configuration.

Extending through the bound edge 142 are a plurality of grommets which receive hooks, such as the hook 144 shown in FIG. 5. The net 140 is secured to the frame by the hooks. In FIG. 5, the hook 144 is shown securing the net 140 to the upper front frame member 40. The frame member 40 is shown in phantom. Preferably, the net 140 is secured to the frame elements 40 and 80, but may or may not also be secured to the diagonal braces 102 and 106. The net 140 will be "deader" if secured only at its top and bottom edges to the frame elements 40 and 80, respectively.

It will be noted, again from referring to FIGS. 1 and 4, that the portable target and catching apparatus 10 includes only a pair of wheels 88 and 98 which are secured to the apparatus at extensions of its lower rear frame member 80. No wheels are provided for the apparatus at the lower front portion, such as to the lower front frame member or element 22. Thus, the lower front frame member 22 preferably rests on the ground, as shown in FIG. 1. The reason for this is for stability purposes. The apparatus 10 is more stable with a pair of wheels disposed only at the rear of the apparatus than if the wheels were located at the front of the apparatus. Accordingly, the apparatus tends to remain in place under the present design conditions regardless of the velocity of the balls thrown at the apparatus and regardless of whether the balls impinge on the front panel 120 or on the rear, dead net 140. However, if the wheels were located at the front of the apparatus, there would be a greater tendency for the apparatus to move than with the wheels disposed at the rear of the apparatus, such as shown.

Under certain conditions it may be advantageous to have additional weight added to the apparatus to further reduce the likelihood of inadvertent moving or creeping of the apparatus. For such added weight, sandbags and the like may be used. Or, and preferably, a pair of cylindrical containers 112 and 114, outlined in phantom in FIG. 2, may be secured to the diagonal braces 102 and 106, respectively. The cylindrical containers 112 and 114 are preferably open at their upper ends and closed at their lower ends. The lower ends may include a drain valve (not shown).

To add weight in a relatively simple manner, the cylinders 112 and 114 may be filled with water after the apparatus 10 is placed in its desired position. The weight of the water in the cylinders substantially decreases the likelihood of the apparatus moving inadvertently. Yet, when it is desired to move the apparatus, through appropriate, well-known valves, the water may be drained from the cylinders 112 and 114.

The use of the water cylinders accordingly is convenient, simple, and inexpensive. Moreover, the draining of the water from the containers will enhance the growth of grass on the playing or practice field and will, usually, be readily absorbed by the ground. The use of such water cylinders appears to be more desirable than the use of separate sandbags or the use of sand in the cylinders 112 and 114.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Pitching target apparatus, comprising, in combination:

front frame means, including a generally horizontally disposed upper frame member, a generally horizontally disposed lower front frame member spaced apart from the upper frame member, a first front side frame member and a second front side frame member spaced apart from each other and connected to the upper and lower frame members, with the upper, lower, first side, and second side frame members defining a generally rectangular front frame;

bottom frame means comprising a base for the apparatus, including a generally horizontally disposed rear frame member spaced apart from and generally parallel to the lower frame member, a first lower side frame member secured to the lower front frame member and to the rear frame member, a second lower side frame member secured to the lower front frame member and to the rear frame member, and spaced apart from the first lower side frame member;

diagonal frame means for supporting the front frame on the base, including a first diagonal frame member extending between and secured to the upper frame member and the rear frame member, a second diagonal frame member extending between and secured to the upper frame member and the rear frame member and spaced apart from the first diagonal frame member;

target panel means secured to the front frame means and including an aperture extending through the target panel means defining a target, including strip means for varying the size of the aperture; and net means spaced apart from the target panel means for stopping projectiles thrown through the aperture in the target panel means.

2. The apparatus of claim 1 in which the bottom frame means includes wheel means for moving the apparatus.

3. The apparatus of claim 2 in which the wheel means includes a pair of wheels rotatably secured to the rear frame member.

4. The apparatus of claim 3 in which the diagonal frame means is pivotally secured to the upper frame member.

5. The apparatus of claim 4 in which the first and second lower side frame members each include a first portion pivotally secured to the lower front frame member, a second portion pivotally secured to the rear frame member, and coupling means for releasably securing together the first and second portions for allowing the front frame means to be aligned with the diagonal frame means for moving and storage.

6. The apparatus of claim 1 in which the strip means includes a first panel adjustably securable to the upper frame member and the lower front frame member of the front frame means for covering a first portion of the aperture, and a second panel adjustably securable to the first front side frame member and the second front side frame member for covering a second portion of the aperture.

7. The apparatus of claim 1 in which the target panel means is secured to the upper frame member, the lower frame member, and to the first and second front side frame members.

8. The apparatus of claim 7 in which the net means is secured to the upper frame member and to the rear frame member.

9. The apparatus of claim 1 which includes weight means to prevent inadvertent movement of the apparatus during use.

* * * * *